US009097454B2

(12) United States Patent
LeClear et al.

(10) Patent No.: US 9,097,454 B2
(45) Date of Patent: Aug. 4, 2015

(54) IN-THE-DOOR COMPACT COOLING SYSTEM FOR DOMESTIC REFRIGERATORS

(71) Applicant: Whirlpool Corporation, Benton Harbor, MI (US)

(72) Inventors: Douglas D. LeClear, Benton Harbor, MI (US); Andrew D. Litch, St. Joesph, MI (US); Guolian Wu, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 227 days.

(21) Appl. No.: 13/758,323

(22) Filed: Feb. 4, 2013

(65) Prior Publication Data

US 2014/0216097 A1 Aug. 7, 2014

(51) Int. Cl.
*F25D 11/02* (2006.01)
*F25D 23/00* (2006.01)

(52) U.S. Cl.
CPC ..... *F25D 11/02* (2013.01); *F25D 23/006* (2013.01); *F25D 2323/00274* (2013.01); *F25D 2400/16* (2013.01)

(58) Field of Classification Search
CPC ..... F25D 11/022; F25D 11/00; F25D 23/02; F25D 23/006; F25D 2323/00274; F25D 11/02; F25D 2400/16; F25B 2400/06
USPC ..... 62/340, 441, 449; 312/405.1, 405
See application file for complete search history.

(56) References Cited

U.S. PATENT DOCUMENTS

| | | | | |
|---|---|---|---|---|
| 1,843,005 | A | | 1/1932 | Steenstrup |
| 2,028,046 | A | | 1/1936 | Calatroni |
| 2,094,542 | A | | 9/1937 | Kuhnel |
| 2,199,413 | A | | 5/1940 | Patrignani |
| 2,282,342 | A | * | 5/1942 | Preble ..... 62/265 |
| 2,401,460 | A | | 6/1946 | Charland |
| 2,433,655 | A | | 12/1947 | Dizoppola |
| 2,496,492 | A | | 2/1950 | Prosek |
| 2,715,040 | A | | 8/1955 | Rhoads, Sr. |
| 2,735,277 | A | | 2/1956 | Clark |
| 2,943,455 | A | | 7/1960 | Reverman, Jr. |
| 3,403,533 | A | * | 10/1968 | Bollenbacher ..... 62/408 |
| 3,438,149 | A | | 4/1969 | Ilg |
| 3,726,578 | A | | 4/1973 | Armstrong |
| 3,821,881 | A | | 7/1974 | Harkias |
| 4,217,010 | A | | 8/1980 | Webb |
| 4,467,618 | A | | 8/1984 | Gidseg |
| 4,638,644 | A | | 1/1987 | Gidseg |

(Continued)

FOREIGN PATENT DOCUMENTS

| | | | |
|---|---|---|---|
| CN | 1721789 | A | 1/2006 |
| DE | 1920683 | A1 | 11/1970 |

(Continued)

OTHER PUBLICATIONS

Translation of DE 1952682 to Ubezio Lorenzo.*

*Primary Examiner* — Mohammad M Ali

(57) ABSTRACT

A refrigerator includes a cabinet defining a refrigerator compartment and a freezer compartment. A door is coupled with the cabinet. A cooling system is disposed in the door and is in fluid communication with the refrigerator compartment and the freezer compartment. A dividing wall is removably coupled with the cabinet and extends between the refrigerator compartment and the freezer compartment. The dividing wall is relocatable within the cabinet to change a relative volume of the refrigerator compartment and the freezer compartment.

20 Claims, 13 Drawing Sheets

(56) References Cited

U.S. PATENT DOCUMENTS

| | | | | |
|---|---|---|---|---|
| 4,895,001 | A | 1/1990 | Jondahl | |
| 5,009,081 | A | 4/1991 | Kruck et al. | |
| 5,187,950 | A | 2/1993 | Weldon | |
| 5,505,046 | A | 4/1996 | Nelson et al. | |
| 6,019,447 | A | 2/2000 | Jackovin | |
| 6,547,349 | B2 | 4/2003 | Sessa et al. | |
| 6,926,379 | B1 | 8/2005 | Grace et al. | |
| 7,410,229 | B2 | 8/2008 | Pohl et al. | |
| 7,410,230 | B2 | 8/2008 | Anderson et al. | |
| 7,451,614 | B2 | 11/2008 | Luehrs et al. | |
| 8,074,464 | B2 * | 12/2011 | Venkatakrishnan et al. | 62/344 |
| 8,261,570 | B2 * | 9/2012 | Shinohara et al. | 62/344 |
| 2005/0138955 | A1 * | 6/2005 | Okuda et al. | 62/441 |
| 2006/0086126 | A1 | 4/2006 | Montuoro | |
| 2007/0138925 | A1 | 6/2007 | Fu | |
| 2007/0180839 | A1 * | 8/2007 | Kim | 62/178 |
| 2007/0209382 | A1 * | 9/2007 | Kim et al. | 62/340 |
| 2007/0228907 | A1 | 10/2007 | Luisi et al. | |
| 2008/0000258 | A1 | 1/2008 | Benz et al. | |
| 2008/0061666 | A1 | 3/2008 | Anderson et al. | |
| 2008/0127670 | A1 * | 6/2008 | Tikhonov et al. | 62/455 |
| 2009/0064701 | A1 | 3/2009 | Bauer et al. | |
| 2009/0165488 | A1 | 7/2009 | Chen | |
| 2009/0308095 | A1 * | 12/2009 | An et al. | 62/351 |
| 2010/0043459 | A1 * | 2/2010 | Wu et al. | 62/73 |
| 2010/0154457 | A1 * | 6/2010 | Kim et al. | 62/340 |
| 2010/0154461 | A1 * | 6/2010 | Lim et al. | 62/428 |
| 2010/0162744 | A1 * | 7/2010 | Lim et al. | 62/377 |
| 2010/0218544 | A1 * | 9/2010 | Fotiadis et al. | 62/407 |
| 2010/0307186 | A1 * | 12/2010 | Kwon et al. | 62/407 |
| 2011/0011116 | A1 * | 1/2011 | Kim et al. | 62/347 |
| 2011/0239687 | A1 * | 10/2011 | Lim et al. | 62/344 |
| 2012/0102997 | A1 * | 5/2012 | Oh et al. | 62/340 |

FOREIGN PATENT DOCUMENTS

| | | | |
|---|---|---|---|
| EP | 0334414 | A2 | 9/1989 |
| FR | 2475379 | | 2/1980 |
| FR | 2812078 | A3 | 1/2002 |
| JP | 8247601 | A | 9/1996 |
| KR | 1020050078424 | | 8/2005 |
| RU | 2224960 | C2 | 2/2004 |
| WO | 2009017283 | A1 | 2/2009 |

* cited by examiner

IN-THE-DOOR COMPACT COOLING SYSTEM FOR DOMESTIC REFRIGERATORS

BACKGROUND OF THE PRESENT INVENTION

The present invention generally relates to a cooling system for a refrigerator, and more specifically, to an in-the-door compact cooling system for domestic refrigerators.

SUMMARY OF THE INVENTION

One aspect includes a refrigerator having a cabinet defining a refrigerator compartment and a freezer compartment. A door is coupled with the cabinet. A cooling system is disposed in the door and is in fluid communication with the refrigerator compartment and the freezer compartment. A dividing wall is removably coupled with the cabinet and extends between the refrigerator compartment and the freezer compartment. The dividing wall is relocatable within the cabinet to change a relative volume of the refrigerator compartment and the freezer compartment.

In another aspect, a door assembly for a refrigerator includes a cabinet defined by a plurality of walls and having a refrigerator compartment and a freezer compartment. A door is coupled with the cabinet. A cooling system is disposed in the door and is in fluid communication with at least one of the refrigerator compartment and the freezer compartment. A dividing wall is removably coupled with the cabinet and extends horizontally between the refrigerator compartment and the freezer compartment. The dividing wall is relocatable within the cabinet to change a relative volume of the refrigerator compartment and the freezer compartment.

In yet another aspect, a door assembly for a refrigerator includes a cabinet defined by a plurality of walls and having a refrigerator compartment and a freezer compartment. A door is coupled with the cabinet. A cooling system is disposed in the door and is in fluid communication with at least one of the refrigerator compartment and the freezer compartment. A dividing wall is removably coupled with the cabinet and extends vertically between the refrigerator compartment and the freezer compartment. The dividing wall is relocatable within the cabinet to change a relative volume of the refrigerator compartment and the freezer compartment.

These and other features, advantages, and objects of the present invention will be further understood and appreciated by those skilled in the art upon studying the following specification, claims, and appended drawings.

DETAILED DESCRIPTION OF EMBODIMENTS

Figure 1A:
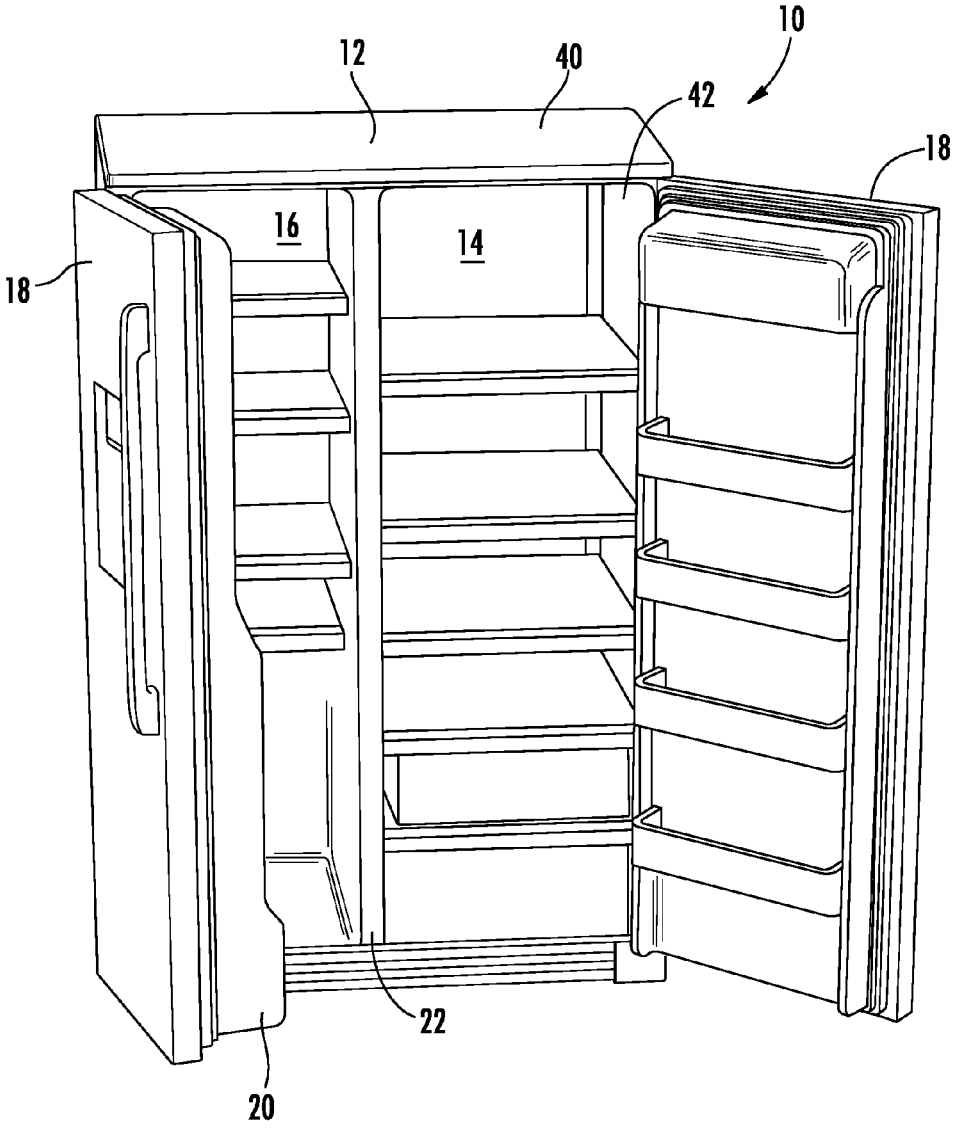
FIG. 1A is a top perspective view of a side-by-side refrigerator having one embodiment of an in-the-door compact cooling system.

For purposes of description herein the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIGS. 1A-16A, reference numeral 10 generally designates a refrigerator having a cabinet 12 defining a refrigerator compartment 14 and a freezer compartment 16. A door 18 is coupled with the cabinet 12. A cooling system 20 is disposed in the door 18 and is in fluid communication with the refrigerator compartment 14 and the freezer compartment 16. A dividing wall 22 is removably coupled with the cabinet 12 and extends between the refrigerator compartment 14 and the freezer compartment 16. The dividing wall 22 is relocatable within the cabinet 12 to change a relative volume of the refrigerator compartment 14 and the freezer compartment 16.

Figure 1B:
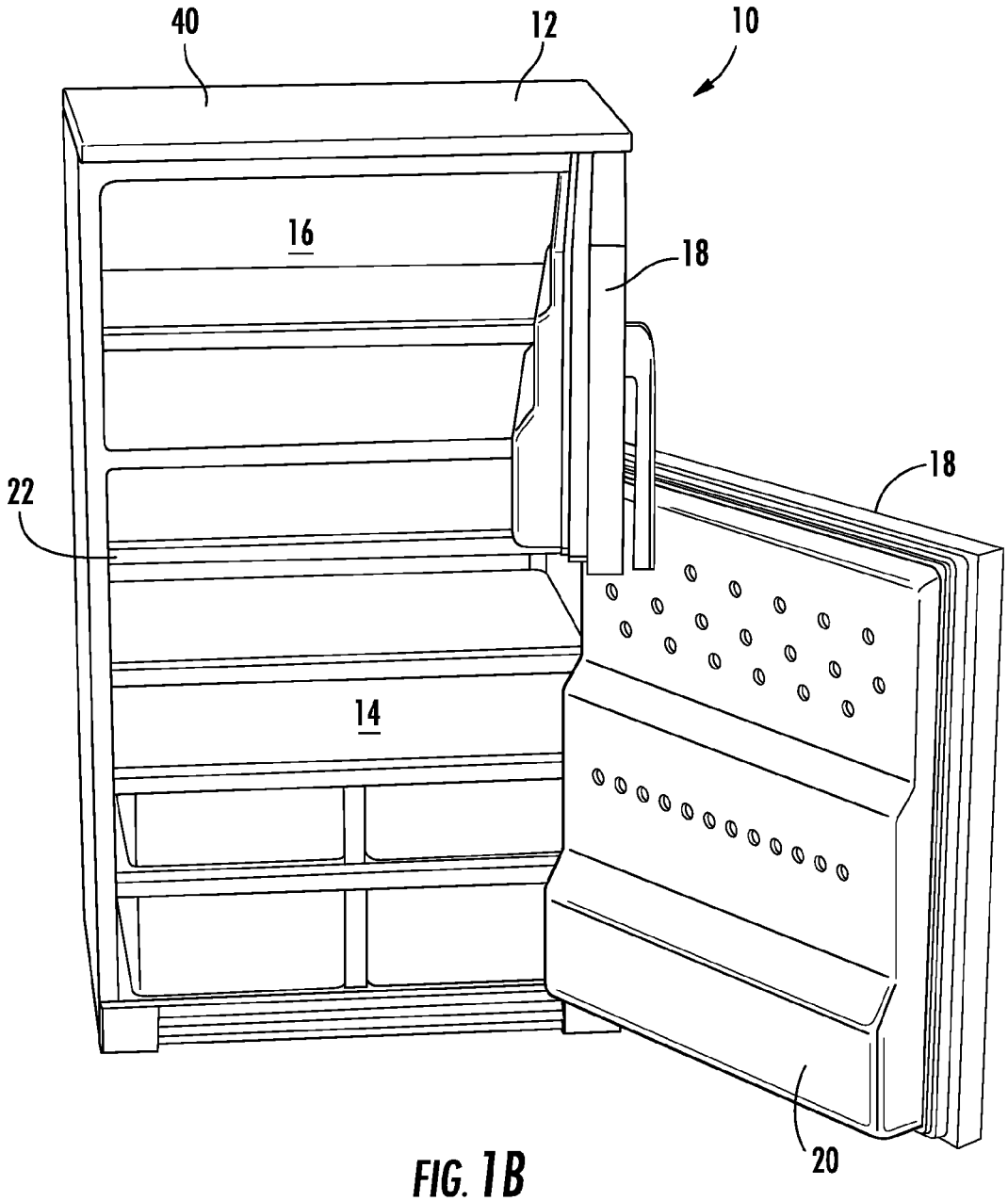
FIG. 1B is a top perspective view of a top mount freezer incorporating one embodiment of an in-the-door compact cooling system.
Figure 1C:
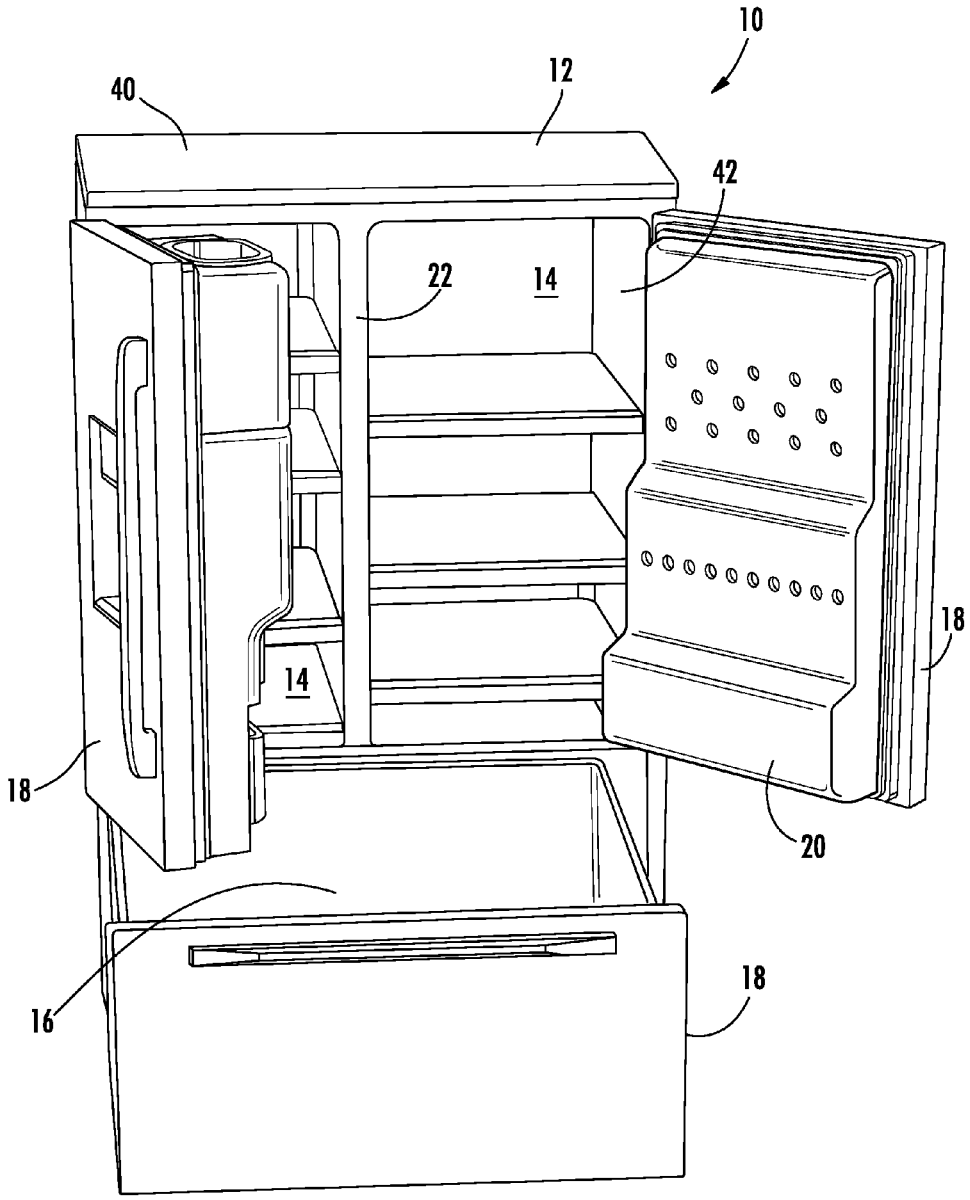
FIG. 1C is a top perspective view of a French-door refrigerator with a bottom mount freezer incorporating another embodiment of the an in-the-door compact cooling system.

Referring now to the various embodiments illustrated in FIGS. 1A-1C, the in-the-door cooling system 20, as set forth herein, is generally designed for use in side-by-side refrigeration models (FIG. 1A), top freezer models (FIG. 1B), and French-door models with bottom freezers (FIG. 1C). It will be generally understood by one having ordinary skill in the art that the in-the-door cooling systems 20 for use with these refrigeration models are configured to cool the refrigerator compartment 14 and freezer compartment 16 of the refrigerator 10, regardless of the size and shape of the door 18. Accordingly, depending on the model, various ventilation and cooling pathways may be utilized inside the cabinet 12 to properly cool fresh foods and frozen foods located inside the refrigerator compartment 14 and the freezer compartment 16, respectively. The door 18 of the refrigerator 10 may be pivotally coupled to the refrigerator 10, positioned on drawer slides, etc.

Figure 2:
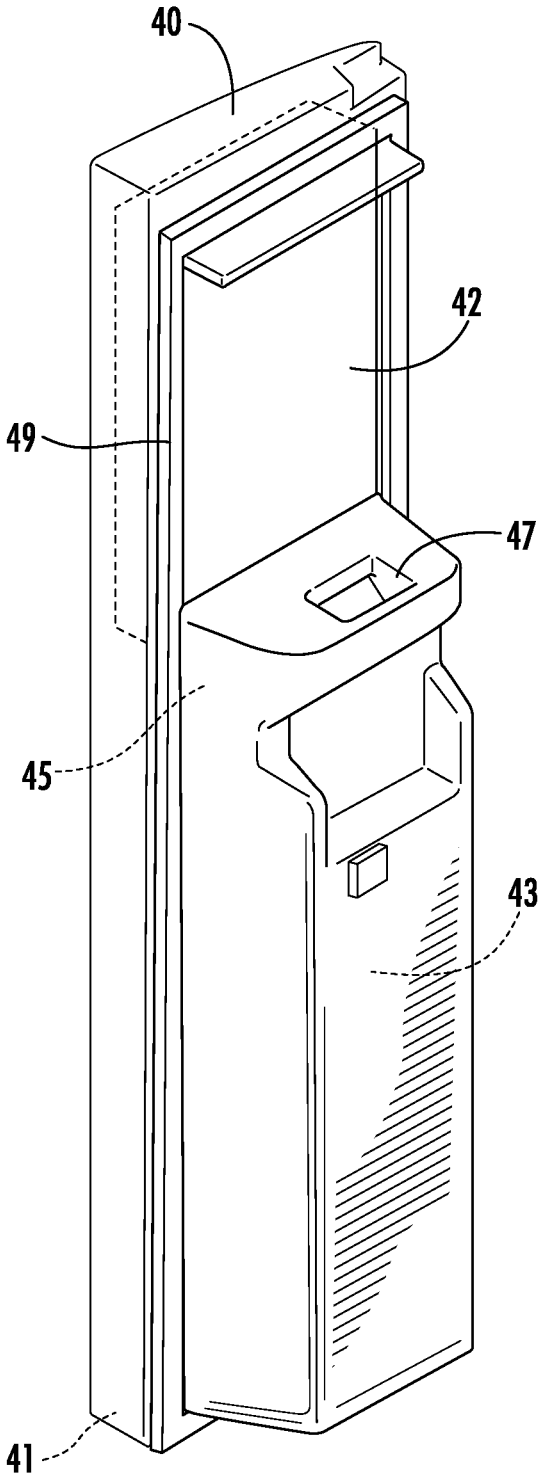
FIG. 2 is a top perspective view of a door including one embodiment of an in-the-door compact cooling system.
Figure 3:
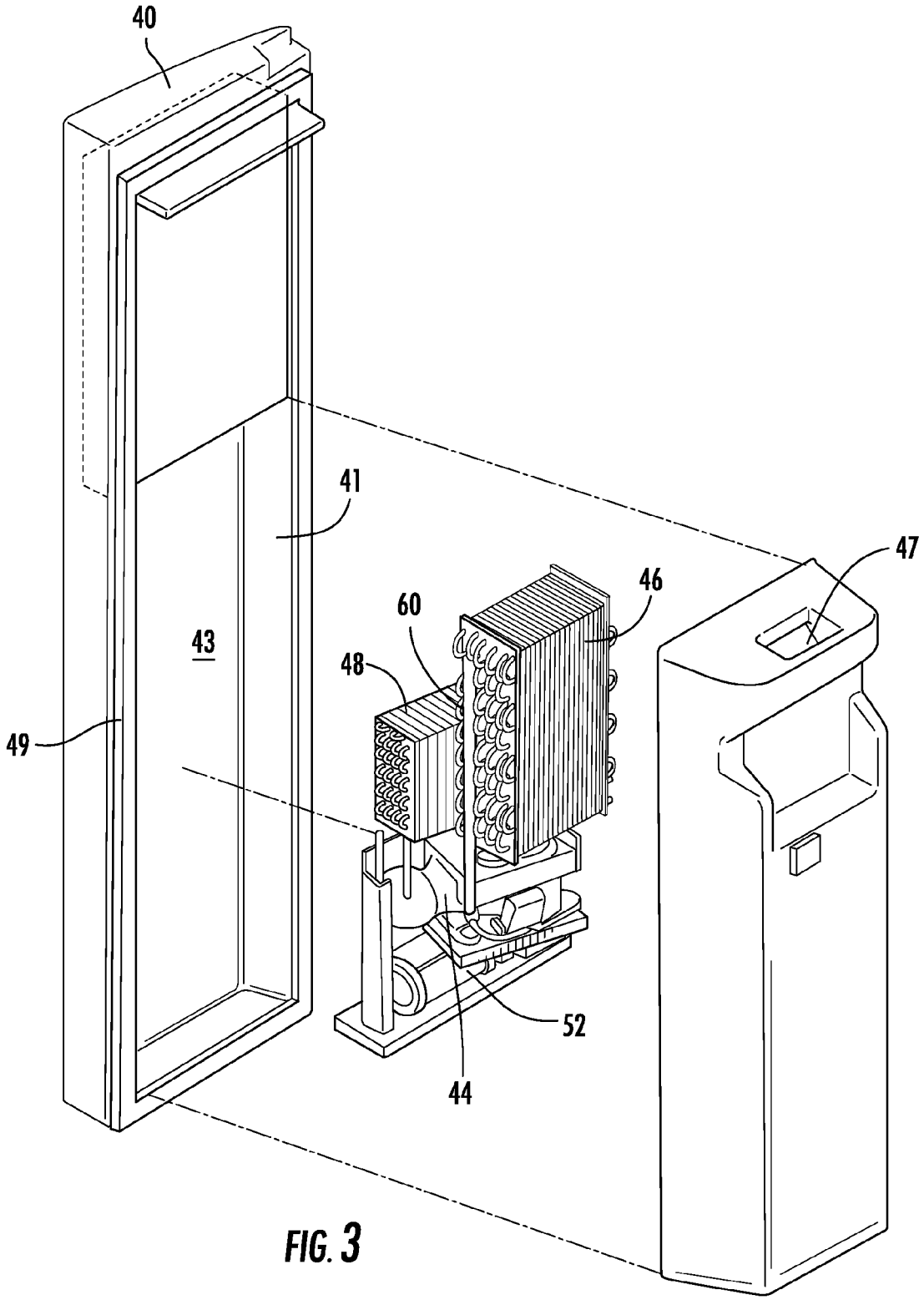
FIG. 3 is a top perspective exploded view of the door of FIG. 2.

Referring now to FIGS. 2 and 3, an exemplary embodiment of the in-the-door cooling system 20 is illustrated. The door 18 and cabinet 12 each include an exterior or outer wrapper 40 configured to engage an interior or inner liner 42. The in-the-door cooling system 20 is disposed between the exterior wrapper 40 and the interior liner 42. The exterior wrapper 40 protects the exterior portion of the door 18, as well as the cabinet 12, and may be constructed of a painted metal, stainless steel, etc. The door 18 includes a frame 41 that supports the exterior wrapper 40 and the interior liner 42. The exterior wrapper 40 and the interior liner 42 define a cavity or a utility space 43 configured to house the cooling system 20. Depending on the size and arrangement of the components, the cooling system 20 may be disposed in a fairly shallow chamber or an enlarged chamber proximate a bottom wall of the door 18. The enlarged chamber may be at least partially defined by an enlarged protrusion on the inner liner 42. The utility space 43 may include an ice dispenser 45 that receives ice from an ice maker through an ice chute. In the illustrated embodiment, a gasket 49 is positioned around the door 18 between the exterior wrapper 40 and the interior liner 42.

Referring again to FIGS. 2 and 3, the cooling system 20 includes a compressor 44, an evaporator 46, a condenser 48, and a capillary tube. In one embodiment, it is contemplated that the evaporator 46 is partially exposed to at least one of the refrigerator compartment 14 and the freezer compartment 16 to chill fresh foods or frozen foods, respectively. As shown in FIG. 3, the evaporator 46 is in communication with a discharge vent 47 that discharges cool air from around the evaporator 46 to the refrigerator compartment 14, the freezer compartment 16, or both. It is also contemplated that a fan 52 may be positioned proximate the evaporator 46 near the discharge vent 47 to blow cool air across the evaporator 46 into one or both of the refrigerator compartment 14 and the freezer compartment 16. As a result of the cooling system 20 being disposed in the door 18, the overall thickness of the door 18 is increased. In addition, sufficient insulation and sound dampening materials may be disposed inside the door 18 to minimize operating noises coming from the compressor 44, the condenser 48, etc. when the in-the-door cooling system 20 is activated, and also to minimize any heat gain that could be passed from the in-the-door cooling system 20 to the refrigerator compartment 14 or the freezer compartment 16. The cooling system 20 is generally designed to be disposed solely in the door 18 of the refrigerator 10. The cooling system 20 is configured to be in fluid communication with the refrigerator compartment 14 and the freezer compartment 16. Further, the cooling system 20 is designed to maintain the temperature of the refrigerator compartment 14 at a different temperature than the freezer compartment 16, as discussed in detail herein.

Figure 4:
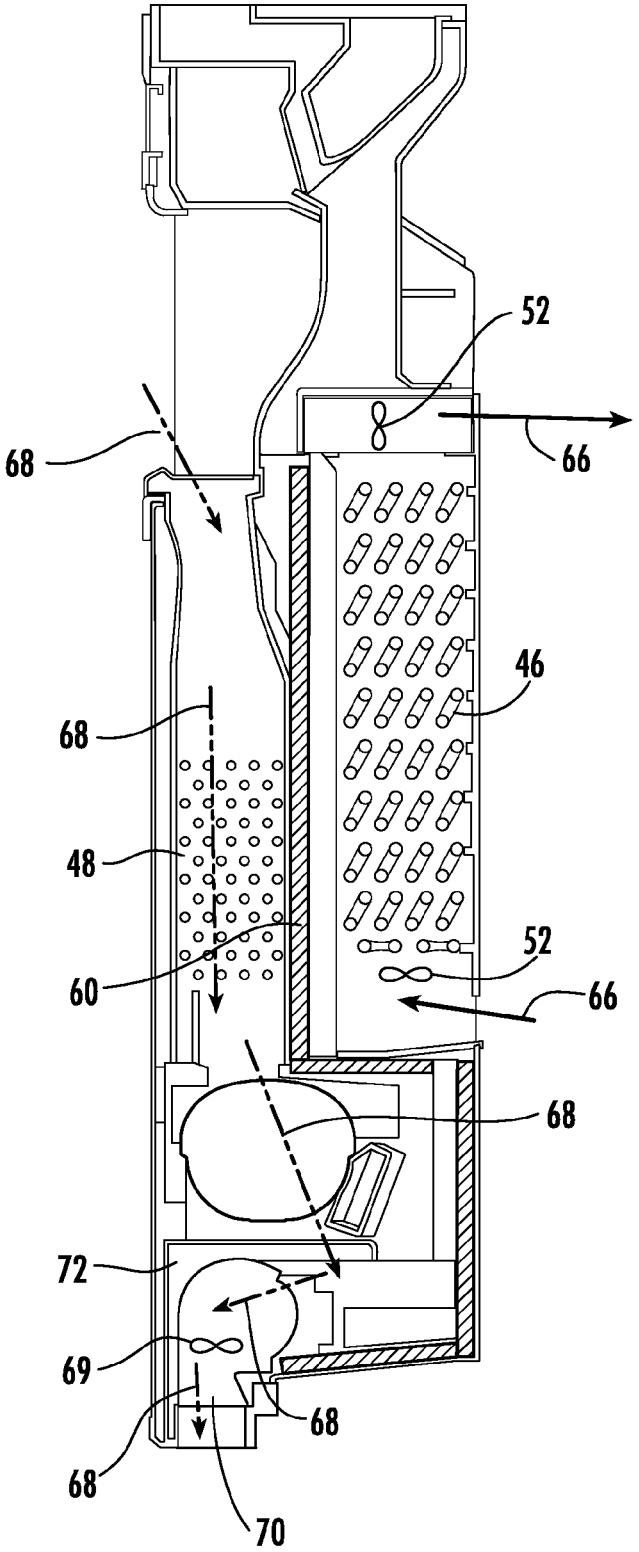
FIG. 4 is a side elevational cross-sectional view of a lower portion of the door of FIG. 2.

In another embodiment, as shown in FIG. 4, a vacuum insulation panel 60 is disposed between the evaporator 46 and the condenser 48. The vacuum insulation panel 60 provides increased insulation preventing any thermal exchange between the evaporator 46 and the condenser 48 when the in-the-door cooling system 20 is operating. In addition, a warm air discharge is disposed below a bottom portion of the door 18 to allow heat to escape from the in-the-door cooling system 20. As illustrated in FIG. 4, air is generally drawn into a top portion of the door 18 past the condenser 48. The air is drawn past the condenser 48 to cool the condenser 48. At the same time, a refrigerant is passed from the condenser 48 from a pump through an expansion device. When the refrigerant reaches the expansion device, the refrigerant cools and is passed through the evaporator 46. The cool air defined by arrows 66 proximate the evaporator 46 flows into or is blown into the refrigerator cabinet 12. Consequently, the refrigerator cabinet 12 is cooled. The air defined by arrows 68 that is drawn into the door 18 past the condenser 48 is heated by the condenser 48 and blown out by a fan 69 through a warm air discharge 70 at a bottom portion 72 of the door 18. This cycle repeats until a satisfactory temperature inside the refrigerator cabinet 12 has been met.

Figure 5:
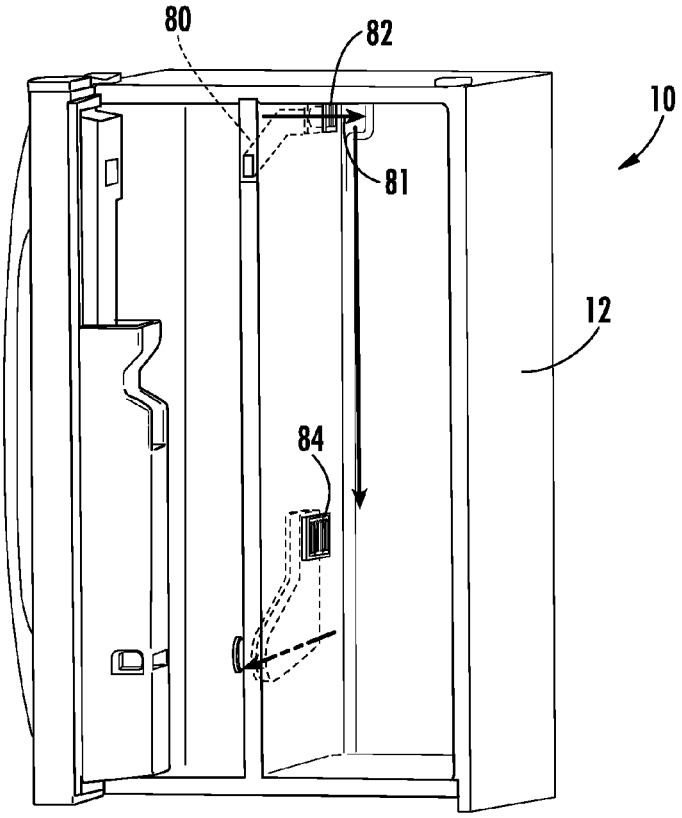
FIG. 5 is a front perspective view of one embodiment of an air pathway system for use with an in-the-door compact cooling system.
Figure 6:
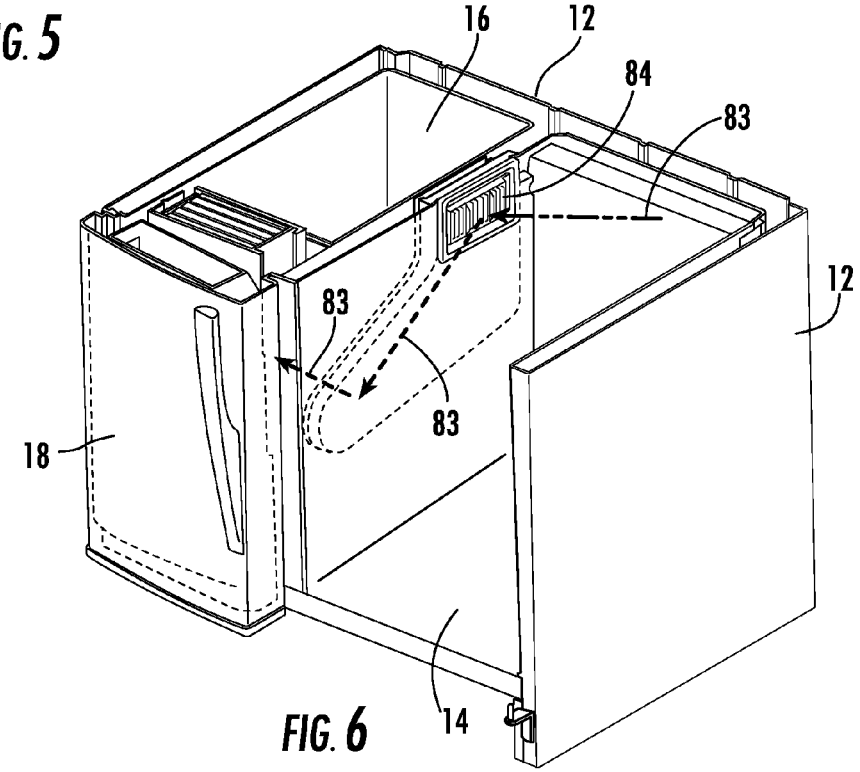
FIG. 6 is a top perspective cross-sectional view of a portion of the air pathway system of FIG. 5.

Referring now to the illustrated embodiment of FIGS. 5 and 6, cool air passes from the evaporator 46 through a channel 80 into the freezer compartment 16. A regulating air vent 82 allows cool air from the freezer compartment 16 to enter into the refrigerator compartment 14. As the cool air defined by arrows 81 makes its way into the refrigerator compartment 14, warm air defined by arrows 83 is drawn through a lower regulating air vent 84 in the bottom portion of the refrigerator compartment 14. The warm air is drawn back into the in-the-door cooling system 20 past the evaporator 46 and cooled again. The same air is ultimately discharged again through the channel 80 into the freezer compartment 16. The regulating air vents 82, 84 are operably coupled with a thermostat or thermistor that measures the temperature in the freezer compartment 16 and the refrigerator compartment 14.

Figure 9:
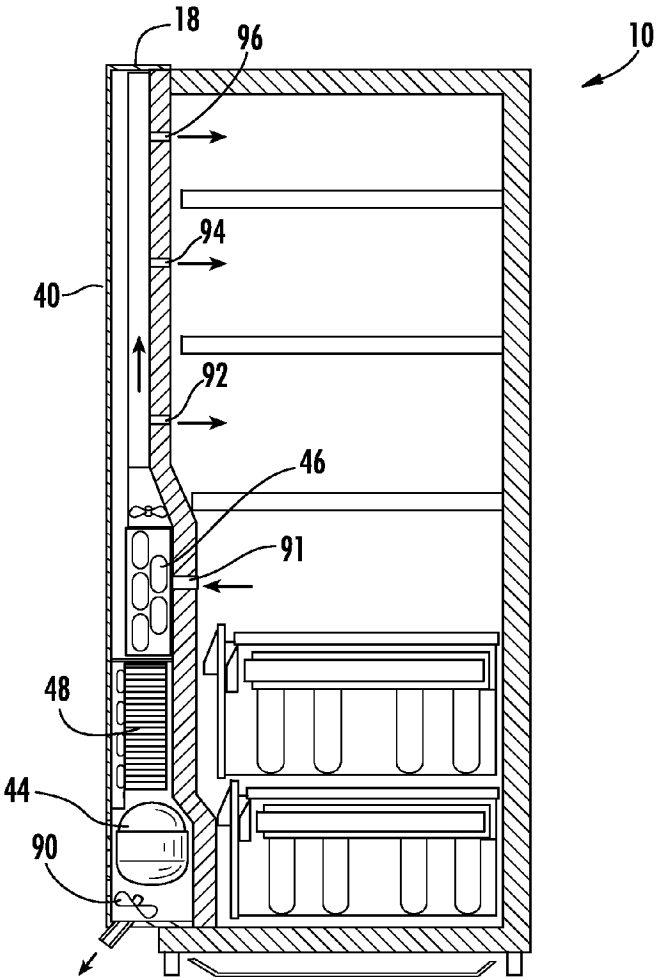
FIG. 9 is a side elevational cross-sectional view of the door of FIG. 7 and refrigerator of FIG. 8 after assembly.
Figure 8:
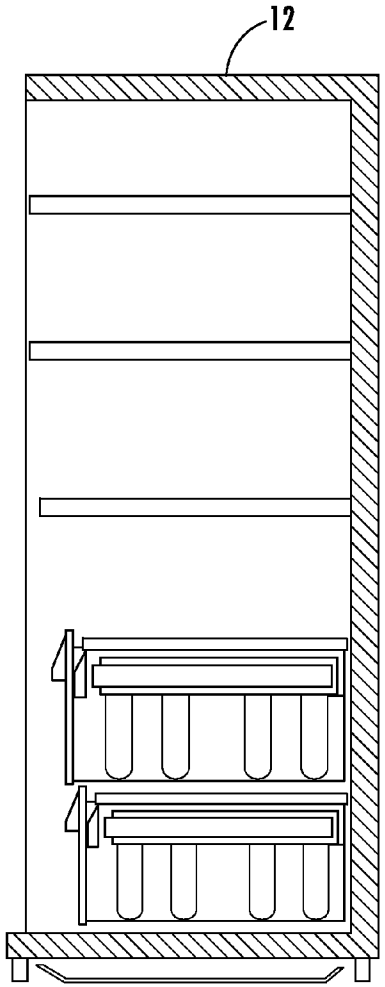
FIG. 8 is a side elevational cross-sectional view of a refrigerator configured for connection with the door of FIG. 7.
Figure 7:
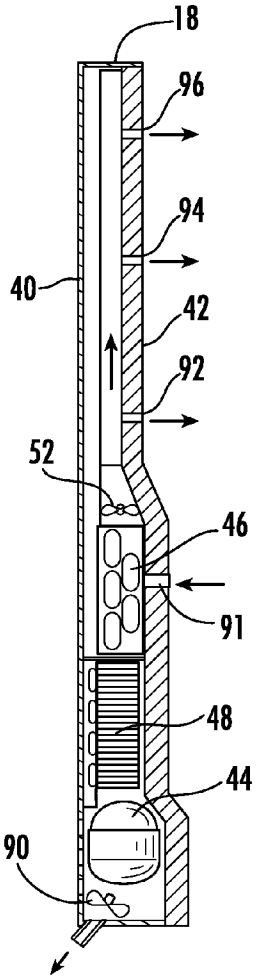
FIG. 7 is a side elevational cross-sectional view of an in-the-door compact cooling system in a refrigerator door.

Referring now to FIGS. 7-9, in one embodiment of the in-the-door cooling system 20, the door 18 includes a warm air discharge fan 90 coupled with the compressor 44 and disposed in the bottom portion of the door 18. The condenser 48 is positioned above the compressor 44 and the evaporator 46 is disposed above the condenser 48. The in-the-door cooling system 20 and the refrigerator cabinet 12 are generally designed to discharge air from the refrigerator compartment 14 into the door 18 past the evaporator 46. The air to be cooled is drawn through an inlet 91 past the evaporator 46 in an upper direction to three cool air discharge sites or outlets 92, 94, 96 at various heights in the interior liner 42 of the freezer compartment 16. As the cool air is discharged into the freezer compartment 16, the freezer compartment 16 is cooled. It is contemplated that a ventilation system, as generally set forth in FIGS. 5 and 6, may be utilized to convey cooled air from the freezer compartment 16 to the refrigerator compartment 14 to cool the contents in the refrigerator compartment 14. As the contents of the refrigerator 10 warm the cool air in the refrigerator compartment 14, the warm air is discharged again past the evaporator 46 and the process repeats.

Figure 12:
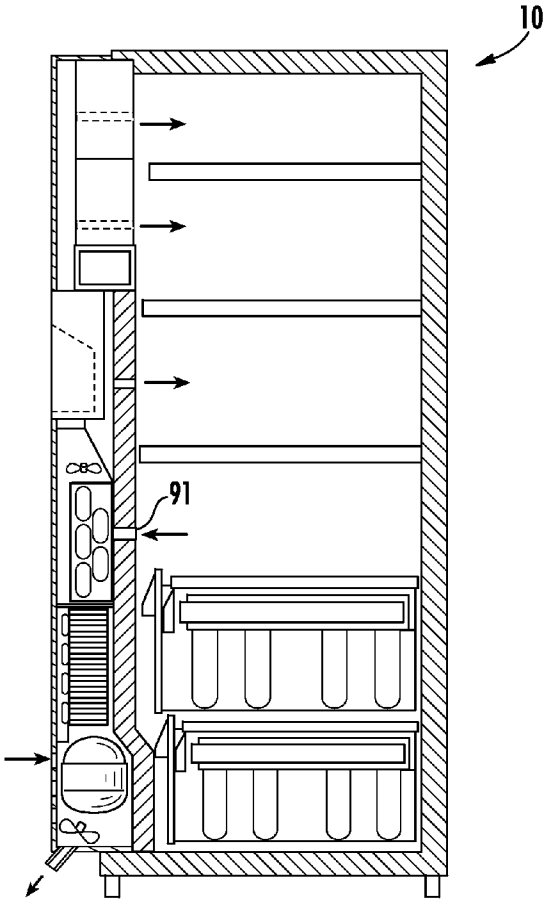
FIG. 12 is a side elevational cross-sectional view of the door of FIG. 10 and the refrigerator of FIG. 11 after assembly.
Figure 11:
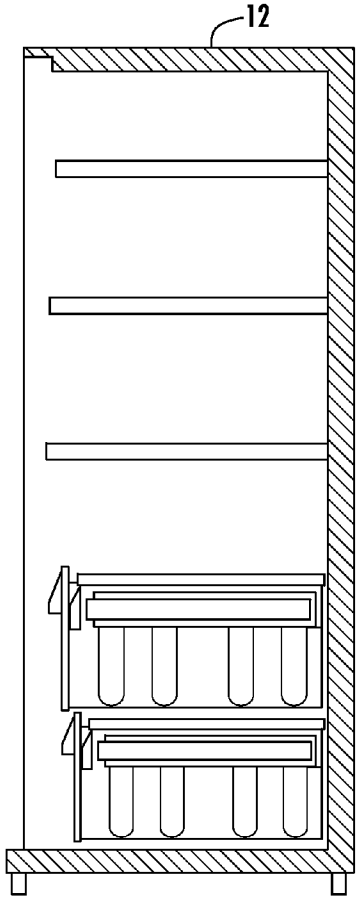
FIG. 11 is a side elevational cross-sectional view of a refrigerator configured for connection with the door of FIG. 10.
Figure 10:
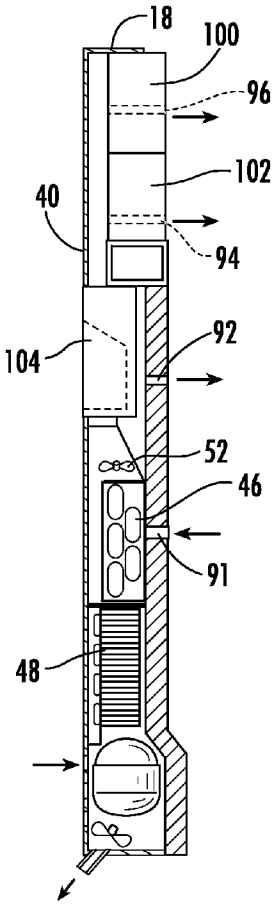
FIG. 10 is a side elevational cross-sectional view of another embodiment of an in-the-door compact cooling system in a refrigerator door.

In another embodiment, as illustrated in FIGS. 10-12, a similar system to that depicted in FIGS. 7-9 is provided. However, in FIGS. 10-12, the door 18 also includes an ice maker 100 and an ice bin 102. The ice maker 100 is disposed above the in-the-door cooling system 20. The ice bin 102 is also disposed above the in-the-door cooling system 20, but is also disposed below the ice maker 100. Accordingly, ice can be made in the ice maker 100 and discharged into the ice bin 102 before delivery to an ice and water dispenser 104 and to a user. The compressor 44, the condenser 48, and the evaporator 46 of the in-the-door cooling system 20 are arranged as set forth in FIGS. 7-9, but convey cool air past the ice and water dispenser 104 to one or more of the discharge sites 92, 94, 96 that extend through the interior liner 42 of the refrigerator door 18.

It will be understood by one having ordinary skill in the art that power may be routed into the refrigerator 10, through a hinge assembly that connects the refrigerator 10 to the door 18 where the power supply is used to power the in-the-door cooling system 20. However, it is also contemplated that the door 18 may include a separate power supply that feeds from the door 18 directly to a power source. Stated differently, it is conceived that the power source does not have to be obtained from the refrigerator 10 directly, but instead from a different power source, such as a home outlet.

Figure 13:
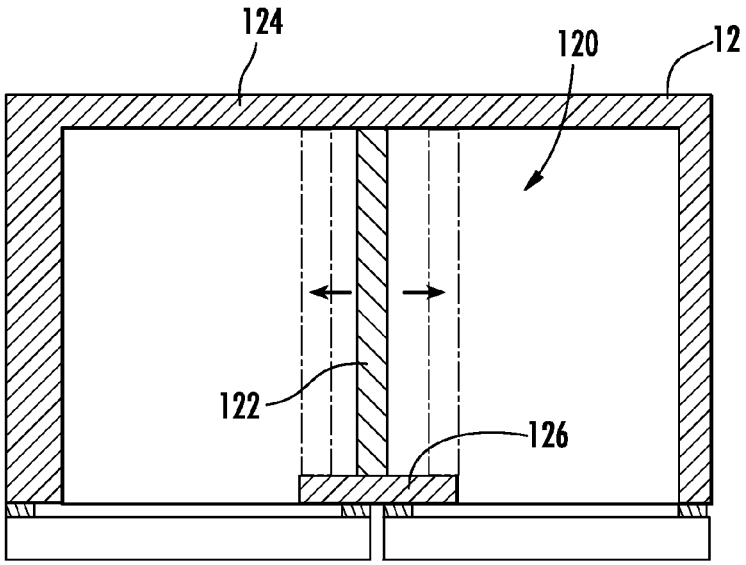
FIG. 13 is a top cross-sectional plan view of one embodiment of a moveable divider wall that is configured for lateral movement inside a refrigerator cabinet and set at a first position.
Figure 13A:
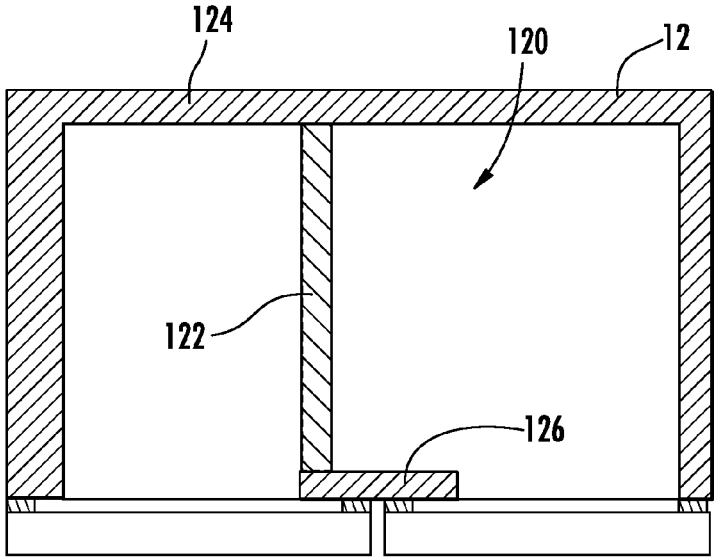
FIG. 13A is a top cross-sectional plan view of the refrigerator cabinet of FIG. 13 with the divider wall moved to a second position.

Referring now to FIGS. 13 and 13A, in one embodiment, the in-the-door cooling system 20 is used in conjunction with a moveable divider 120 that allows a user to customize the total available volume in the refrigerator compartment 14 and the freezer compartment 16. A dividing wall 122 is generally designed to abut a rear wall 124 of the refrigerator cabinet 12, as well as a forward door abutment member 126. The forward door abutment member 126 is stationary inside the cabinet 12 and does not move with the dividing wall 122. The dividing wall 122 can be positioned in a substantially central location, providing relatively equal volume between the refrigerator compartment 14 and the freezer compartment 16. Alternatively, as depicted in FIG. 13A, the dividing wall 122 can be moved to a second alternate location that decreases the volume in the freezer compartment 16 and increases the volume in the refrigerator compartment 14. Alternatively, if the user desires greater freezer space, the dividing wall 122 can be moved to yet another position that increases the volume of the freezer compartment 16 while minimizing the volume of the refrigerator compartment 14. Thus, the dividing wall 122 allows the user to customize a desired volume of space provided in the freezer compartment 16 and the refrigerating compartment 14.

Figure 14:
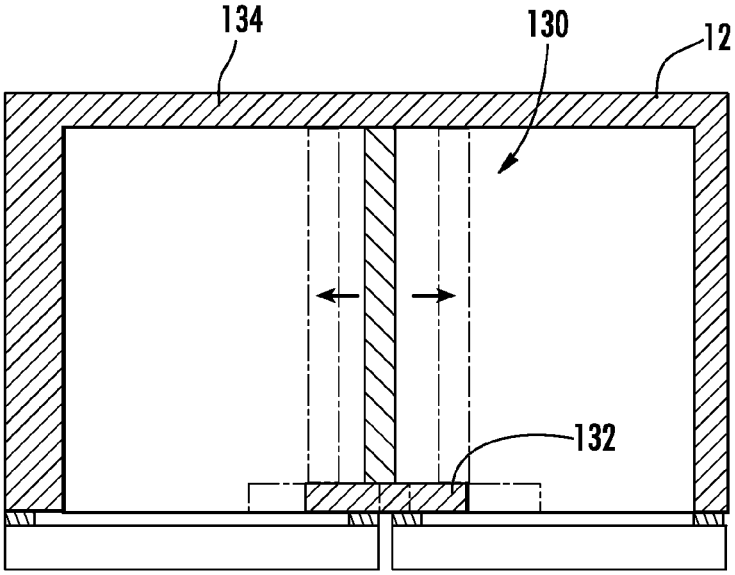
FIG. 14 is a top cross-sectional plan view of another embodiment of a moveable divider wall that is configured for lateral movement inside a refrigerator cabinet and set to a first position.
Figure 14A:
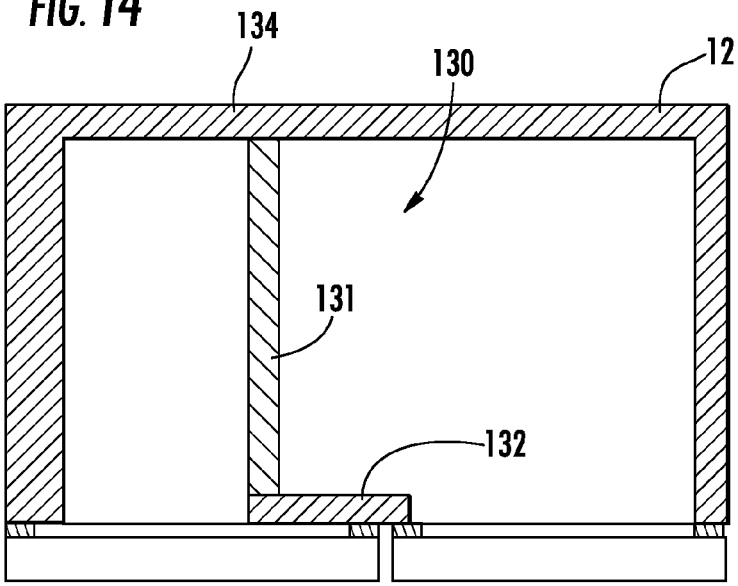
FIG. 14A is a top cross-sectional plan view of the cabinet of FIG. 14 with the divider wall moved to a second position.

Referring now to FIGS. 14-14A, in another embodiment, a moveable divider 130 includes both a dividing wall 131 and a forward door abutment member 132, which are moveable to allow customization of the volume of space in the refrigerator compartment 14 and the freezer compartment 16. The dividing wall 131 seals the refrigerator compartment 14 and the freezer compartment 16 by abutting a rear wall 134 of the cabinet 12 and the forward door abutment member 132 in any of a variety of positions. In this embodiment, it is contemplated that sealing gaskets 49 are disposed on the door 18 and that the forward door abutment member 132 has a substantially planar surface that allows for abutment of the gaskets 49 against the forward door abutment member 132 to seal the refrigerator compartment 14 and the freezer compartment 16. It will be understood by one having ordinary skill in the art that the forward door abutment member 132 may be moveable independent of the dividing wall 131. Accordingly, the forward door abutment member 132 may be moved to a position to minimize the space in the freezer compartment 16, and at the same time, the dividing wall 131 may be moved further into the freezer compartment 16 (FIG. 14A) to minimize the overall volume of the freezer compartment 16 to an even greater extent than is available in the embodiment discussed above with regard to FIGS. 13 and 13A.

Figure 15:
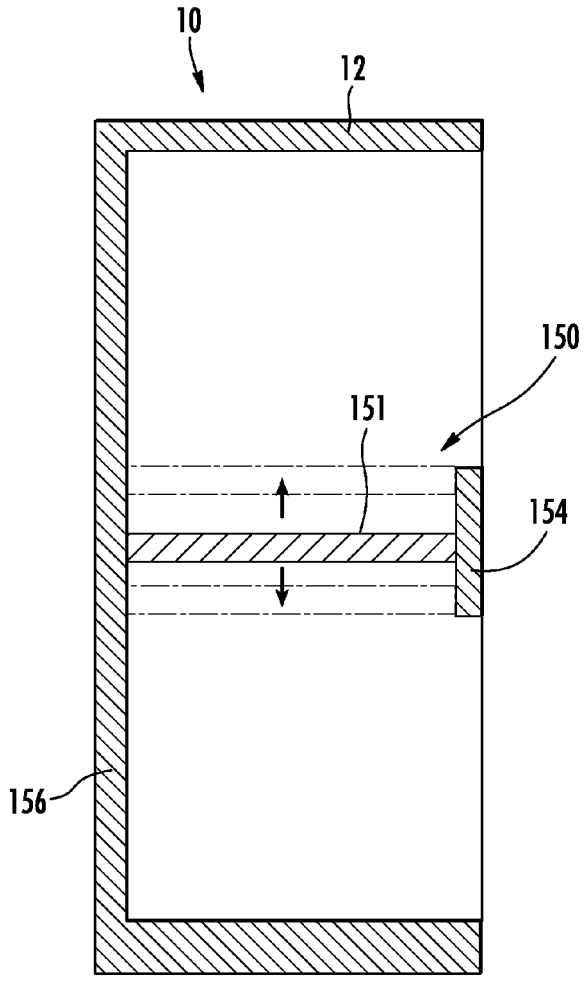
FIG. 15 is a top cross-sectional plan view of one embodiment of a moveable divider wall that is configured for vertical movement inside a refrigerator cabinet and set at a first position.
Figure 15A:
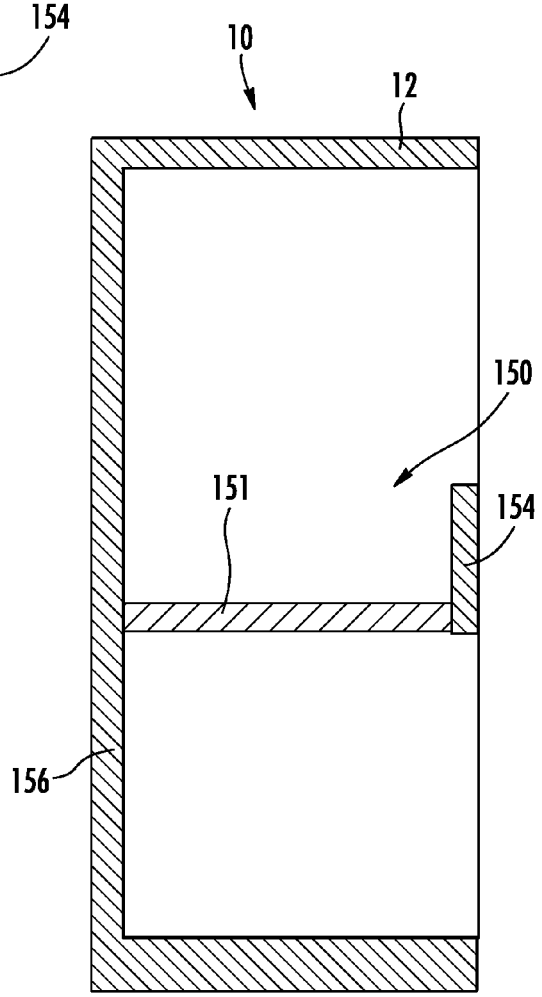
FIG. 15A is a top cross-sectional plan view of the refrigerator cabinet of FIG. 15 with the divider wall moved to a second position.

Referring now to FIGS. 15 and 15A, in the illustrated embodiment, a moveable divider 150 includes a vertically adjustable dividing wall 151 that is adapted for adjustment between a rear wall 156 of the cabinet 12 of the refrigerator 10 and a forward door abutment member 154. The forward door abutment member 154 remains stationary and extends across the refrigerator 10 from a first side wall to a second side wall of the refrigerator cabinet 12 and to the rear wall 156. The dividing wall 151 is vertically moveable between a variety of upper and lower positions to increase or decrease the relative volume of the refrigerator compartment 14 and the freezer compartment 16. For example, as illustrated in FIG. 15A, the dividing wall 151 may be moved to a lower position to minimize the overall volume in the freezer compartment 16 while maximizing the overall volume in the refrigerator compartment 14.

Figure 16:
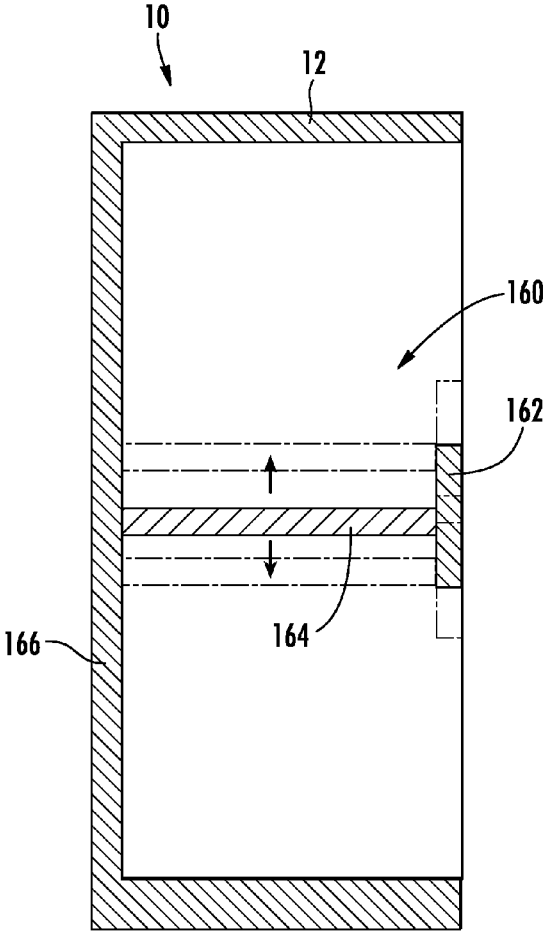
FIG. 16 is a top cross-sectional plan view of another embodiment of a moveable divider wall that is configured for vertical movement inside a refrigerator cabinet.
Figure 16A:
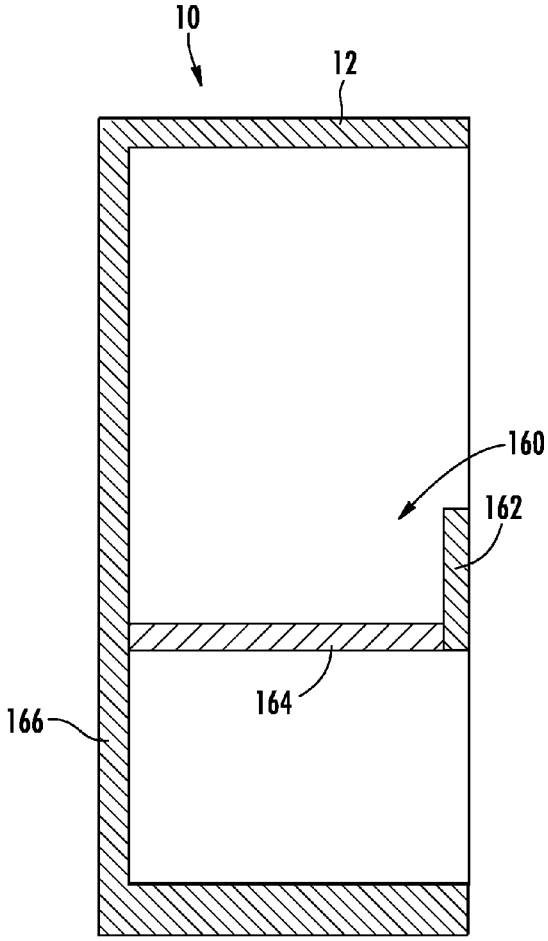
FIG. 16A is a top cross-sectional plan view of the cabinet of FIG. 16 with the divider wall moved to a second position.

Referring now to FIGS. 16 and 16A, in yet another embodiment, a moveable divider 160 includes a forward door abutment member 162 and a dividing wall 164 for use in a refrigerator 10 that has a bottom mount freezer. The dividing wall 164 abuts and seals against the forward door abutment member 162 and a rear wall 166 of the cabinet 12. The moveable divider 160 is adjustable such that the relative volume of the refrigerator compartment 14 and the freezer compartment 16 may be adjusted. For example, as illustrated in FIG. 16A, the forward door abutment member 162 and the dividing wall 164 may be moved together to a lower position to minimize the volume in the freezer compartment 16 and to maximize the volume in the refrigerator compartment 14. Alternatively, as shown in FIG. 16B, the forward door abutment member 162 may be lowered to the lowermost position available to the forward door abutment member 162, and at the same time, the dividing wall 164 may be moved to a lower position on the forward door abutment member 162 to minimize the volume of the freezer compartment 16 to a greater extent. Accordingly, the overall volume of the refrigerator compartment 14 is increased significantly.

In another embodiment, a first cooling system is provided in the refrigerator door. The first cooling system maintains a temperature of the refrigerator compartment 14 at a first temperature. At the same time, a second cooling system is disposed in the freezer door. The second cooling system maintains the freezer compartment 16 at a second temperature that is different than the first temperature of the refrigerator compartment 14. It is likely that the temperature in the freezer compartment 16 will be maintained at a temperature lower than that of the refrigerator compartment 14. This assembly will most likely be used with a French door refrigerator construction having a lower freezer cabinet that is pivotally or slidably connected with the refrigerator 10. Alternatively, this configuration may be used with a side-by-side refrigerator construction. The components disposed in the freezer door and the refrigerator door may be similar or identical components that operate at different temperatures. Alternatively, the components disposed in the refrigerator door and the freezer door may be different. The remaining features and components discussed herein may be applied in both the first and second cooling systems, as will be appreciated by one having ordinary skill in the art.

It is also contemplated that the first and second cooling systems disposed in the refrigerator door 18 and the freezer door, respectively, can include at least one common component. The common component could be any of the compressor 44, the evaporator 46, condenser 48, capillary tube, etc. In one embodiment, it is contemplated that the evaporator 46 is shared by the first and second cooling systems and is at least partially exposed in the refrigerator cabinet 12. Alternatively, the evaporator 46 may be exposed in the freezer compartment 16.

It will be understood by one having ordinary skill in the art that construction of the described invention and other components is not limited to any specific material. Other exemplary embodiments of the invention disclosed herein may be formed from a wide variety of materials, unless described otherwise herein.

It is generally contemplated that this system may take on a variety of different constructions. The examples set forth herein are provided as illustrative embodiments only. Other manners of conveying the warm air from the refrigerator compartment back to the in-the-door cooling system may also be employed.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The above description is considered that of the illustrated embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

What is claimed is:

1. A refrigerator comprising:

a cabinet defining a refrigerator compartment and a freezer compartment;

a door coupled with the cabinet;

an abutment member abutting the door and translatable in one of a vertical direction and a horizontal direction;

a cooling system disposed in the door and in fluid communication with the refrigerator compartment and the freezer compartment; and a dividing wall removably coupled with the cabinet and extending between the refrigerator compartment and the freezer compartment, wherein the dividing wall is continuously relocatable along the abutment member within the cabinet to change a relative volume of the refrigerator compartment and the freezer compartment.

2. The refrigerator of claim 1, wherein the cooling system includes a compressor, an evaporator, a condenser, and a capillary tube.

3. The refrigerator of claim 2, wherein the evaporator is at least partially exposed to one of the refrigerator compartment and the freezer compartment.

4. The refrigerator of claim 3, wherein cool air proximate the evaporator is blown into at least one of the refrigerator compartment and the freezer compartment.

5. The refrigerator of claim 1, further comprising:

a warm air discharge disposed at a bottom portion of the door.

6. The refrigerator of claim 1, wherein the door includes an ice maker disposed above the cooling system.

7. The refrigerator of claim 2, further comprising:

a vacuum insulation panel disposed between the evaporator and the condenser.

8. A door assembly for a refrigerator comprising:

a cabinet defined by a plurality of walls and including a refrigerator compartment and a freezer compartment;

a door coupled with the cabinet and including a gasket;

a movable abutment member translatable in a vertical direction;

a cooling system disposed in the door and in fluid communication with at least one of the refrigerator compartment and the freezer compartment; and a dividing wall removably coupled with the cabinet and extending horizontally between the refrigerator compartment and the freezer compartment, wherein the dividing wall is relocatable along the abutment member within the cabinet to change a relative volume of the refrigerator compartment and the freezer compartment.

9. The door assembly of claim 8, wherein the movable abutment member is adapted to engage the gasket on the door.

10. The door assembly of claim 8, wherein the dividing wall includes a peripheral gasket adapted to abut the plurality of walls of the cabinet.

11. The door assembly of claim 8, wherein cool air developed by the cooling system is blown into a top portion of the freezer compartment.

12. The door assembly of claim 8, further comprising:

a warm air discharge disposed at a bottom portion of an exterior side of the door.

13. The door assembly of claim 8, wherein the door includes an ice maker disposed above the cooling system.

14. The door assembly of claim 8, further comprising:

a vacuum insulation panel disposed between an evaporator and a condenser.

15. A door assembly for a refrigerator comprising:

a cabinet defined by a plurality of walls and including a refrigerator compartment and a freezer compartment;

a door coupled with the cabinet;

a movable abutment member configured to abut the door when the door is in a closed position;

a cooling system disposed in the door and in fluid communication with at least one of the refrigerator compartment and the freezer compartment; and a dividing wall removably coupled with the cabinet and extending vertically between the refrigerator compartment and the freezer compartment, wherein the dividing wall is relocatable within the cabinet along the abutment member to change a relative volume of the refrigerator compartment and the freezer compartment.

16. The door assembly of claim 15, wherein the movable abutment member defines a substantially planar abutment surface adapted to engage a gasket on the door.

17. The door assembly of claim 15, wherein the dividing wall includes a peripheral gasket adapted to abut the plurality of walls of the cabinet.

18. The door assembly of claim 15, wherein the door includes a gasket member adapted to engage a planar surface on the dividing wall.

19. The door assembly of claim 18, wherein the gasket member extends through a mid-portion of an interior wall of the door.

20. The door assembly of claim 15, wherein the door includes an ice maker and an ice dispenser disposed above the cooling system in the door.

* * * * *